United States Patent [19]

Kamimura

[11] 4,090,429

[45] May 23, 1978

[54] FAIL-SAFE FLUID CONTROL VALVE

[75] Inventor: Toshio Kamimura, Fuwa, Japan

[73] Assignee: Teijin Seiki Company Limited, Osaka, Japan

[21] Appl. No.: 686,222

[22] Filed: May 12, 1976

[30] Foreign Application Priority Data

Jul. 21, 1975 Japan ..... 50-89027

[51] Int. Cl.[2] ..... F15B 13/04

[52] U.S. Cl. ..... 91/466; 91/363 A; 137/596; 137/625.69

[58] Field of Search ..... 91/466, 363 A; 137/625.69, 596

[56] References Cited

U.S. PATENT DOCUMENTS

| | | | |
|---|---|---|---|
| 2,613,650 | 10/1952 | Mott | 91/363 A |
| 2,771,907 | 11/1956 | Joy | 137/625.48 X |
| 3,152,610 | 10/1964 | McAfee, Jr. | 137/625.69 X |
| 3,253,613 | 5/1966 | Richolt | 137/625.69 X |
| 3,439,707 | 4/1969 | York et al. | 137/596 |
| 3,556,155 | 1/1971 | Morris et al. | 137/625.69 |
| 3,768,376 | 10/1973 | Orme | 137/625.69 X |
| 3,899,001 | 8/1975 | Orme | 137/625.69 X |

*Primary Examiner*—Irwin C. Cohen
*Attorney, Agent, or Firm*—Haseltine, Lake & Waters

[57] ABSTRACT

A fail-safe fluid control valve including a first sleeve fixedly accommodated in a valve housing, a second sleeve reciprocably movably received in the first sleeve. The first and second sleeves are suitably grooved and ported, and the valve spool is formed properly with annular flanges. When there occur such abnormal conditions that the second sleeve and the valve spool are jammed or stuck to each other, the second sleeve is adapted to be moved in unison with the valve spool to actuate the fail-safe fluid control valve under entirely the same conditions as normal conditions.

3 Claims, 14 Drawing Figures

FAIL-SAFE FLUID CONTROL VALVE

Figure 1:
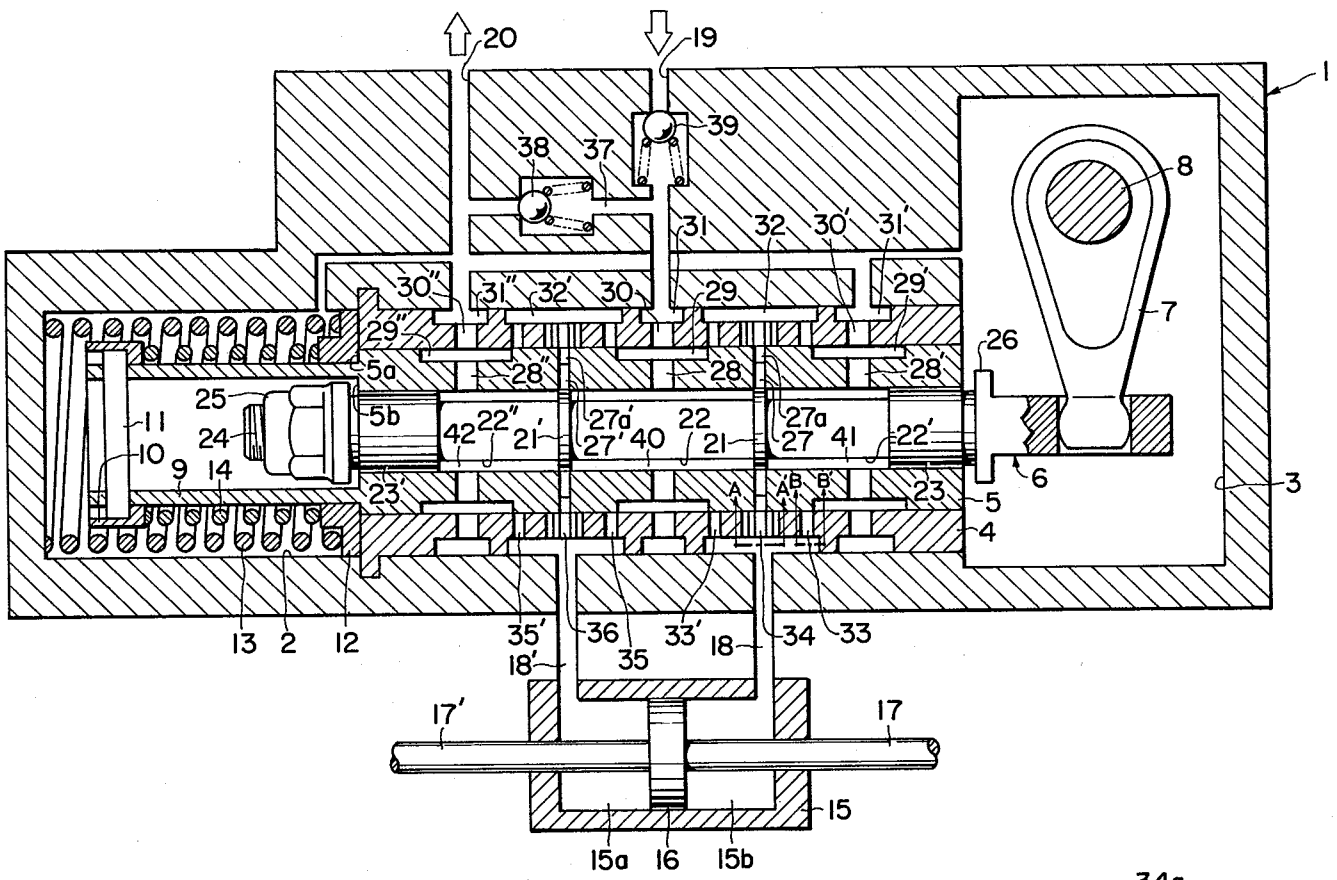

This invention relates to a fail-safe fluid control valve for use in aircrafts and the like, and more particularly to a control valve including two valve means one of which can be normally operated while the other is under abnormal conditions such as accidents and stoppage thereof.

It is generally a common practice to use a fail-safe fluid control valve in mechanical systems required for high reliability as for example aircraft flight control systems for their movable wings. Conventionally, there have been provided a variety of such fail-safe fluid control valves which, however, can not satisfactorily actuate their control actuators under abnormal conditions. Moreover, great flow loss takes place and their null positions of the control actuators are displaced between under normal and abnormal conditions, which results in deteriorating controllability of the aircraft using the conventional control valves.

It is therefore a primary object of the present invention to provide a fail-safe fluid control valve which can satisfactorily operate its control actuator even under abnormal conditions.

It is another object of the present invention to provide a fail-safe fluid control valve which eliminates great flow loss and makes the null position of the control actuator constant between under normal and abnormal conditions.

It is a further object of the present invention to provide a fail-safe fluid control valve which facilitate controllability of the aircraft.

In order to accomplish the foregoing objects, a fail-safe fluid control valve embodying the present invention comprises: a valve housing having first and second concave portions formed therein, a first sleeve positioned within and fixed to the first concave portion of the valve housing, a second sleeve reciprocably movably provided in the first sleeve, a valve spool reciprocably movably provided in the second sleeve, an input lever provided in the second concave portion of the valve housing for pivotally connecting to the end portion of the valve spool to axially reciprocably move the valve spool and to axially reciprocably move the second sleeve upon jamming of the valve spool and the second sleeve, resilient means provided within the first concave portion of the valve housing to resiliently move the second sleeve at its predetermined position against the movement of the input lever, a valve cylinder to be provided in fluidal communication with the first concave portion of the valve housing, an inlet conduit arranged in the valve housing for supplying a pressure oil to the first concave portion of the valve housing, an outlet conduit arranged in the valve housing for discharging said pressure oil from the first concave portion of the valve housing, a pair of cylinder conduits connecting the first concave portion of the valve housing and the valve cylinder for supplying the pressure oil to the valve cylinder and discharging the pressure oil from the valve cylinder, the improvement comprising in combination; the valve spool including a pair of annular flanges at a predetermined distance in its axial direction for forming first, second and third small diameter portions therebetween and exteriorly thereof; the second sleeve including first and second orifice groups of each consisting of one or more radial bores circumferentially aligned, the first and second orifice groups being positioned at a predetermined distance at the axial direction substantially equal to that of each of the annular flanges so as to be closed by the annular flanges upon opposing thereto; first, second and third groups of ports opposing to the first, second and third small diameter portions, respectively, and each group consisting of one or more radial bores formed in circumferential alignment with each other in the second sleeve; and first, second and third annular grooves formed in the outer wall portion of the second sleeve in fluidal communication with the first, second and third groups of ports, respectively; the first sleeve including fourth, fifth and sixth groups of ports opposing to the first, second and third annular grooves, respectively, of the second sleeves and each group consisting of one or more radial bores formed in circumferential alignment with each other in the first sleeve; fourth, fifth and sixth annular grooves in the outer wall portion of the first sleeve in fluidal communication with the fourth, fifth and sixth groups of ports, the fourth annular groove being fluidally communicated with the inlet conduit, and the fifth and sixth annular grooves being fluidally communicated with the bifurcated ends of the outlet conduit; a seventh annular groove formed in the wall portion of the first sleeve between the fourth and fifth annular grooves and fluidally communicated with one of the cylinder conduits; an eighth annular groove formed in the wall portion of the first sleeve between the fourth and sixth annular grooves and fluidally communicating with the other of the cylinder conduits; a fifth orifice group including one or more radial bores circumferentially aligned and each bore having an axial length substantially three times that of each of the flanges, each bore having an outer opening fluidally communicated with the seventh annular groove and an inner opening fluidally communicated with the inner wall of the first sleeve; third and fourth orifice groups positioned axially at the sides of the fifth orifice group and each group consisting of one or more radial bores circumferentially aligned and each bore having an axial length substantially equal to that of each of the flanges, the third and fourth orifice groups of bores having respective outer openings fluidally communicated with the seventh annular groove and respective inner openings closed by the outer wall of the second sleeve upon the fifth orifice group axially coinciding with the first orifice group; an eighth orifice group including one or more radial bores circumferentially aligned and each bore having an axial length substantially three times that of each of the flanges, each bore having an outer opening fluidally communicated with the eighth annular groove and an inner opening fluidally communicated with the second orifice group upon the fifth orifice group axially coincided with the first orifice group; sixth and seventh orifice groups positioned axially at the sides of the eight orifice group and each group consisting of one or more radial bores circumferentially aligned and each bore having an axial length substantially equal to that of each of the flanges, the sixth and seventh groups of bores having respective outer openings fluidally communicated with the eighth annular groove and respective inner openings closed by the outer wall of the second sleeve upon the fifth orifice group axially coinciding with the first orifice group.

In the above fail-safe fluid control valve each bore of the fifth orifice group may consist of a large central cross-sectioned aperture, a pair of small cross-sectioned side apertures positioned at both sides of the large central cross-sectioned aperture, and a pair of tapered intermediate cross-sectioned apertures positioned between and connecting the central and side apertures, and each bore of the eighth orifice group may consist of a large central cross-sectioned aperture, a pair of small cross-sectioned side apertures positioned at both sides of the large central cross-sectioned aperture, and a pair of tapered intermediate cross-sectioned apertures positioned between and connecting the central and side apertures.

On the other hand, the fail-safe fluid control valve may comprise a first annular orifice groove formed in the outer wall portion of the first sleeve in axial alignment with the first orifice group, and a second annular orifice groove formed in the outer wall portion of the first sleeve in axial alignment with the second orifice groove.

Figure 2B:
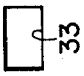
Figure 2A:
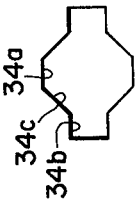

The features and advantages of the fail-safe fluid control valve according to the present invention will become more apparent from the following description of the apparatus taken in conjunction with the accompanying drawings, in which:

FIG. 1 is a cross-sectional view of a preferred embodiment of the fail-safe fluid control valve according to the present invention;

FIG. 2*a* is an enlarged view as shown from the lines A—A' in FIG. 1;

FIG. 2*b* is a cross-sectional view as shown from the lines B—B' in FIG. 2; and FIGS. 3 to 13 are cross-sectional views similar to FIG. 1 but showing different steps of the control valve.

Reference will now be made to FIGS. 1 to 13, especially to FIG. 1. The fail-safe fluid control valve embodying the present invention is shown comprising a valve housing, generally designated by reference numeral 1, which is formed having a first concave portion 2 laterally extending therein and a second concave portion 3 formed at the side thereof to communicate with the first concave portion 2. Within the first concave portion 2 is provided a first sleeve 4 securely connected to the inner wall of the first concave portion 2 to reciprocably movably receive a second sleeve 5. A valve spool 6 is reciprocably movably received within the second sleeve 5 and has a right end pivotablly connected to a free end of an input lever 7 which has, in turn, a fixed end securely mounted on a drive shaft 8 drivably connected to an output shaft of a suitable rotating mechanism. The rotation of the drive shaft 8, therefore, permits the input lever 7 to be swung either in clockwise or counterclockwise direction so that the valve spool 6 is reciprocably moved along its own axis. A projection 9 is integrally connected to the left end of the second sleeve 5 which is formed having a pair of cut-away portions 5*a* and 5*b* which are adapted to radially inwardly and outwardly extend. On the extreme end of the projection 9 is securely mounted a fixed collar 10 by means of a pin member 11 radially attached to the projection 9. A movable collar 12 is adapted to be slidably received on the projection 9 and is urged to be pressed against the left surface of the first sleeve 4 by a first coil spring 13, accommodated in the left of the first concave portion 2 of the valve housing 1, when the second sleeve 5 is not exerted by any foreign forces. A second spring 14 is provided between the fixed and movable collars 10 and 12 surrounding the projection 9 to normally urge the second sleeve 5 toward a left direction thereof. The first and second coil springs 13 and 14 retain a substantially equal spring constant so that the right end surface of the movable collar 12 is in abutting engagement with the cut-away portion 5*a* of the second sleeve 5 and the left end surface of the first sleeve 4 to locate the second sleeve 5 at a predetermined position. A valve cylinder 15 is adapted to reciprocably accommodate a piston 16 which has both side surfaces fixed to piston rods 17 and 17'. To the both ends of the valve cylinder 15 are attached one ends of a pair of cylinder conduits 18 and 18' which have the other ends connected to the first concave portion 2 of the valve housing 1. The connected positions of the other ends of the cylinder conduits 18 and 18' will be described in greater details hereinafter. Inlet and outlet conduits 19 and 20 are formed in the valve housing 1 and will also be described in greater details hereinafter with respect to the connection with other associated parts. The valve spool 6 is formed with a pair of generally annular flanges 21 and 21' at a predetermined space along its own axis so as to provide first, second and third small diameter portions 22, 22' and 22'' between the both flanges 21 and 21' and at the exterior portions thereof. At the extreme outer ends of the small diameter portions 22' and 22'' are formed large diameter portions 23 and 23', respectively, the latter left outer end having a threaded portion 24 screwed with a nut 25 to make a distance between the right end surface of the nut 25 and the left end surface of the large diameter portion 23' to be substantially equal to the width of each of the flanges 21 and 21'. On the outer portion of the valve spool 6 exteriorly of the large diameter portion 23 is formed a substantially annular ring 26 to be remote from the right end surface of the large diameter portion 23 by a substantially equal distance to the width of each of the flanges 21 and 21'. When the valve spool 6 is thus moved either in its left direction through the input lever 7 by a stroke amount twice the width of each of the flanges 21 and 21', the left end surface of the annular ring 26 of the spool 6 is brought into abutting relation with the right end surface of the second sleeve 5 to move the second sleeve 5 in a left direction thereof, or the right end surface of the nut 25 comes to be engaged with the cut-away portion 5*b* to move the second sleeve 5 in a right direction thereof. First and second radial orifices 27 and 27' are so formed in the inner peripheral portion of the second sleeve 5 as to have a substantially equal distance to the distance between the flanges 21 and 21' in an axial direction of the spool 6. The first and second radial orifices 27 and 27' are each preferably circumferentially equi-angularly arranged to become in opposing relation with each of the flanges 21 and 21' upon the axial movement of the spool 6 so that they are closed at their radially inner end by the flanges 21 and 21'. First and second annular orifice grooves 27*a* and 27*a'* are formed in the outer peripheral wall portion of the second sleeve 5 in axial alignment with the first and second orifices 27 and 27', respectively. In the present invention, only one orifice may be formed in fluidal communication with each of the first and second annular orifice grooves 27*a* and 27*a'*. First, second and third ports 28, 28' and 28'' are each composed of one or more radial bores circumferentially equi-angularly disposed in the second sleeve 5 and have respective radially inner openings opposing to the first, second and third small diameter portions 22, 22' and 22'', respectively. First, second and third annular grooves 29, 29' and 29'' are so formed in the outer wall portion of the second sleeve 5 as to be in fluidal communication with the first, second and third ports 28, 28' and 28'', respectively. Fourth, fifth and sixth ports 30, 30' and 30'' are each constituted by one or more radial bores circumferentially equiangularly disposed in the first sleeve 4 and have respective radially inner openings opposing to the first, second and third annular grooves 29, 29' and 29''. Fourth, fifth and sixth annular grooves 31, 31' and 31'' are also so formed in the outer wall portion of the first sleeve 4 so as to be in fluidal communication with the fourth, fifth and sixth ports 30, 30' and 30''. A seventh annular groove 32 is formed in the peripheral wall portion of the first sleeve 4 between the fourth annular groove 31 and the fifth annular groove 31', while an eighth annular groove 32' is formed in the peripheral wall portion of the first sleeve 4 between the fourth annular groove 31 and the sixth annular groove 31''. Third and fourth radial orifices 33 and 33' have respective radially outer openings which are disposed at both outer ends of the bottom surface of the seventh annular groove 32 and radially inner openings which are in contact with and closed by the outer surface of the second sleeve 5 when the first orifices 27 are axially aligned with radially inner openings of fifth orifices 34 which will be described in greater details hereinafter. The third and fourth orifices 33 and 33' are each composed of one or more radial bores which are disposed equi-angularly along the circumference of the first sleeve 4 and each of which has an axial length substantially the same as the width of each of the flanges 21 and 21'. The fifth orifices 34 just described above is constituted by one or more radial bores which are circumferentially equi-angularly formed in the first sleeve 4 between the third orifices 33 and the fourth orifices 33' and each of which has a radially outer opening in fluidal communication with the seventh annular groove 32 and a radially inner opening connected to the first annular orifice groove **27*a* under normal conditions. Each of the fifth orifices 34 is formed substantially three times the width of each of the flanges 21 and 21' in its axial length. Sixth and seventh radial orifices 35 and 35' have respective radially outer openings which are disposed at both outer ends of the bottom surface of the eighth annular groove 32' and respective radially inner openings which are in contact with and closed by the outer surface of the second sleeve 5 when the first orifices 27 are axially aligned with radially inner openings of the fifth orifices 34. The sixth and seventh orifices 35 and 35' are each composed of one or more radial bores which are disposed equi-angularly along the circumference of the first sleeve 4 and each of which has an axial length substantially the same as the width of each of the flanges 21 and 21'. An eighth orifice 36 is constituted by one or more radial bores which are circumferentially equiangularly formed in the first sleeve 4 between the sixth orifices 35 and the seventh orifices 35' and each of which has a radially outer opening in fluidal communication with the eighth annular groove 32' and a radially inner opening connected to the central portion of the second annular orifice groove 27*a'* under normal conditions. Each of the eighth orifices has an axial length substantially three times the width of each of the flanges 21 and 21'. The fifth and sixth annular grooves 31' and 31'' are connected to the bifurcated ends of the outlet conduit 20, and the fourth annular groove 31 is connected to the inlet conduit 19. The seventh and eighth annular grooves 32 and 32' are connected to the other ends of the cylinder conduits 18 and 18', respectively. Between the inlet and outlet conduits 19 and 20 in the valve housing 1 is formed a by-pass passage 37 for fluidal connection thereto in which a check valve 38 is disposed in place. An additional check valve 39 is also arranged in the inlet conduit 19**.

As best shown in FIG. **2*a*, the opening of the fifth orifice 34 is profiled having a larger central cross-sectioned aperture 34*a*, a pair of small cross-sectioned side apertures 34*b* positioned at both sides of the large central cross-sectioned apertures 34*a*, and a pair of tapered intermediate cross-sectional apertures 34*c* positioned between and connecting the central and side apertures 34*a* and 34*b*. The configuration of the opening of the eighth orifice 36 is substantially equal to that of the fifth orifice 34. The opening of the third orifice 33 is profiled in a substantially rectangular form in cross-section as best shown in FIG. 2*b*. The configuration of the opening of each of the fourth, sixth and seventh orifices 33', 35 and 35' is substantially equal to that of the third orifice 33**.

The right end of the valve spool 6 is connected to the piston rod 17 by means of a suitable feed-back mechanism (not shown) which serves to automatically return the fail-safe fluid control valve of the present invention to its null position upon movement of the piston 16 away from the null position. Such a feed-back mechanism is well known in the art and thus will not be described in the specification hereinafter.

The operation of the fail-safe control valve thus constructed and arranged will now be described with reference to FIGS. 1 to 13.

Figure 3:
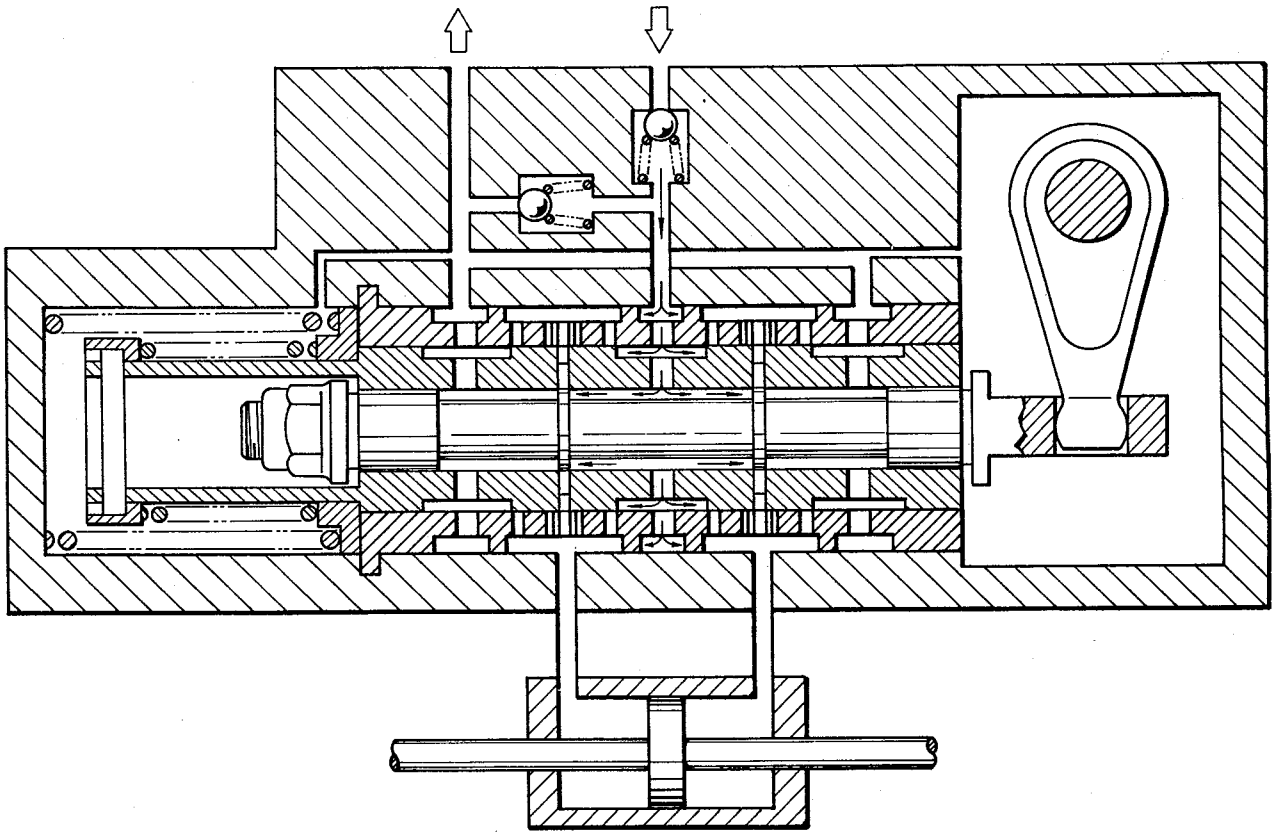
Figure 4:
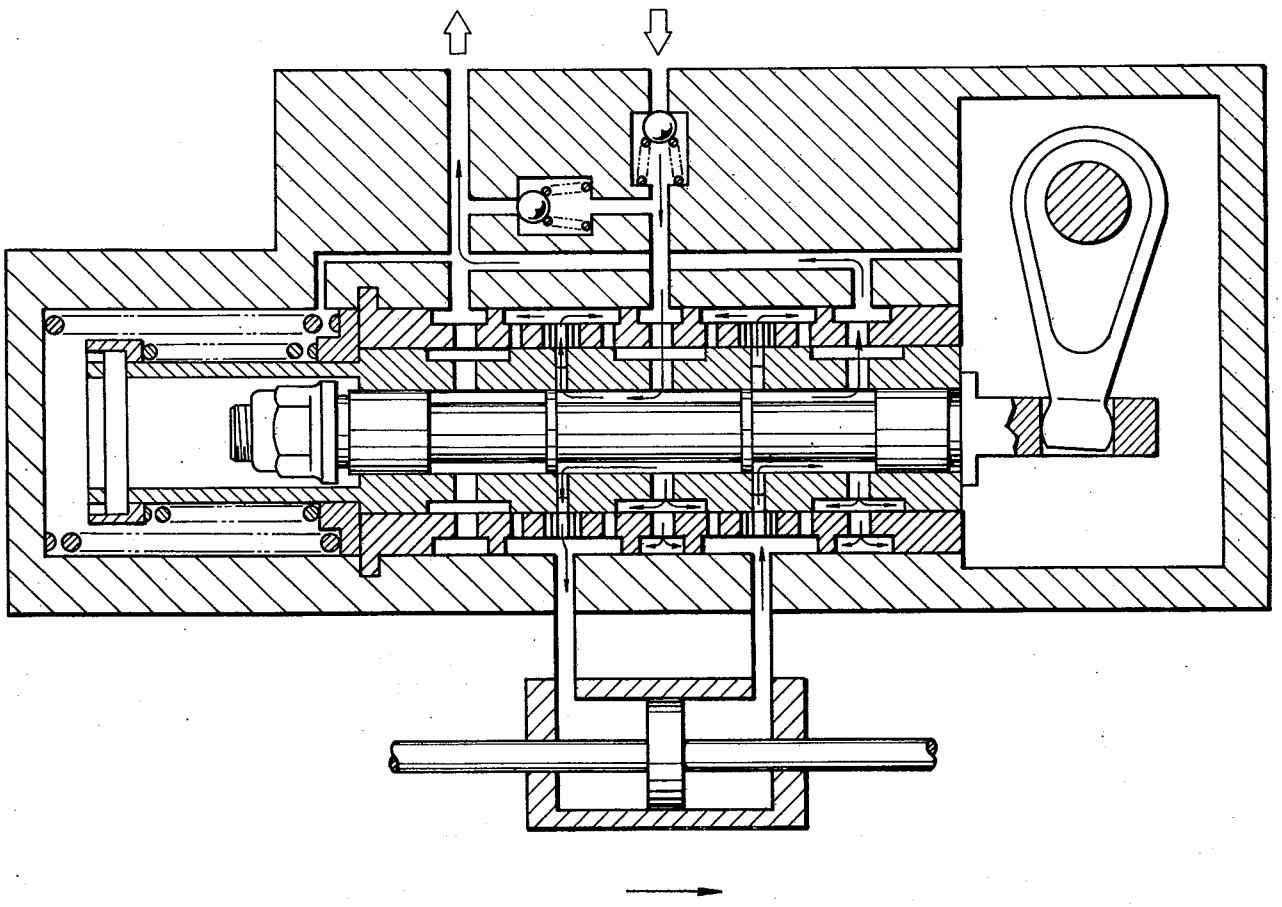

When the control valve embodying the present invention is held at a null position under normal conditions with the input lever 7 in a substantial vertical position as shown in FIG. 3, the inner openings of the fifth and eighth orifices 34 and 36 are kept in fluidal communication with the first and second annular orifice grooves **27*a*, 27*a'*, respectively, while the flanges 21 and 21' close the first and second orifices 27 and 27', respectively. Under these conditions, the distance between the left surface of the cut-away portion 5*b* of the second sleeve 5 and the right surface of the nut 25 as well as the distance between the right surface of the second sleeve 5 and the left surface of the annular ring 26 are held substantially equal to the width of each of the flanges 21 and 21'. The third, fourth, sixth and seventh orifices 33, 33', 35 and 35' are also being closed by the outer periphery of the second sleeve 5. When a pressure oil is supplied through the inlet conduit 19 from a pressure oil source (not shown) under these conditions, the pressure oil, which is supplied to the fourth annular groove 31, the fourth ports 30, the first annular groove 29, and the first ports 28 through the check valve 39, is not fed into the valve cylinder 15 to move the piston 16 in either direction since the flanges 21 and 21' are retained closing the first and second orifices 27 and 27'. When the free end of the input lever 7 is rotated in a clockwise direction to engage the left surface of the annular ring 26 with the right surface of the second sleeve 5 as shown in FIG. 4, the flanges 21 and 21' are moved in a left direction away from the first and second orifices 27 and 27', respectively. At this time, the pressure oil introduced through the inlet conduit 19 enters the fourth annular groove 31, the fourth ports 30, the first annular groove 29 and the first ports 28, and thereafter flows into a left chamber 15*a* of the valve cylinder 15 through an annular chamber 40 defined by the flanges 21, 21', the small diameter portion 22 and the inner wall of the second sleeve 5, and through the second orifices 27', the second annular orifice groove 27*a'*, the eight orifices 36, the eighth annular groove 32'** and the cylinder conduit 18′ so that the piston 16 and the piston rods 17 and 17′ are moved in a right direction. On the other hand, the pressure oil remained in a right chamber 15*b* of the cylinder 15 enters the cylinder conduit 18, the seventh annular groove 32, the fifth orifices 34, the first annular orifice groove 27*a* and the first orifice 27, and thereafter is discharged from the outlet conduit 20 through an annular chamber 41 defined by the flange 21, the large diameter portion 23, the small diameter portion 22′ and the inner wall of the second sleeve 5 and through the second ports 28′, the second annular groove 29′, the fifth ports 30′ and the fifth annular groove 31′. Upon the right movement of the piston rods 17 and 17′, the feed-back mechanism causes the valve spool 6 to move in a right direction so that the control valve return its null position as shown in FIG. 3, resulting in preventing the piston rods 17 and 17′ from excessively running.

Figure 5:
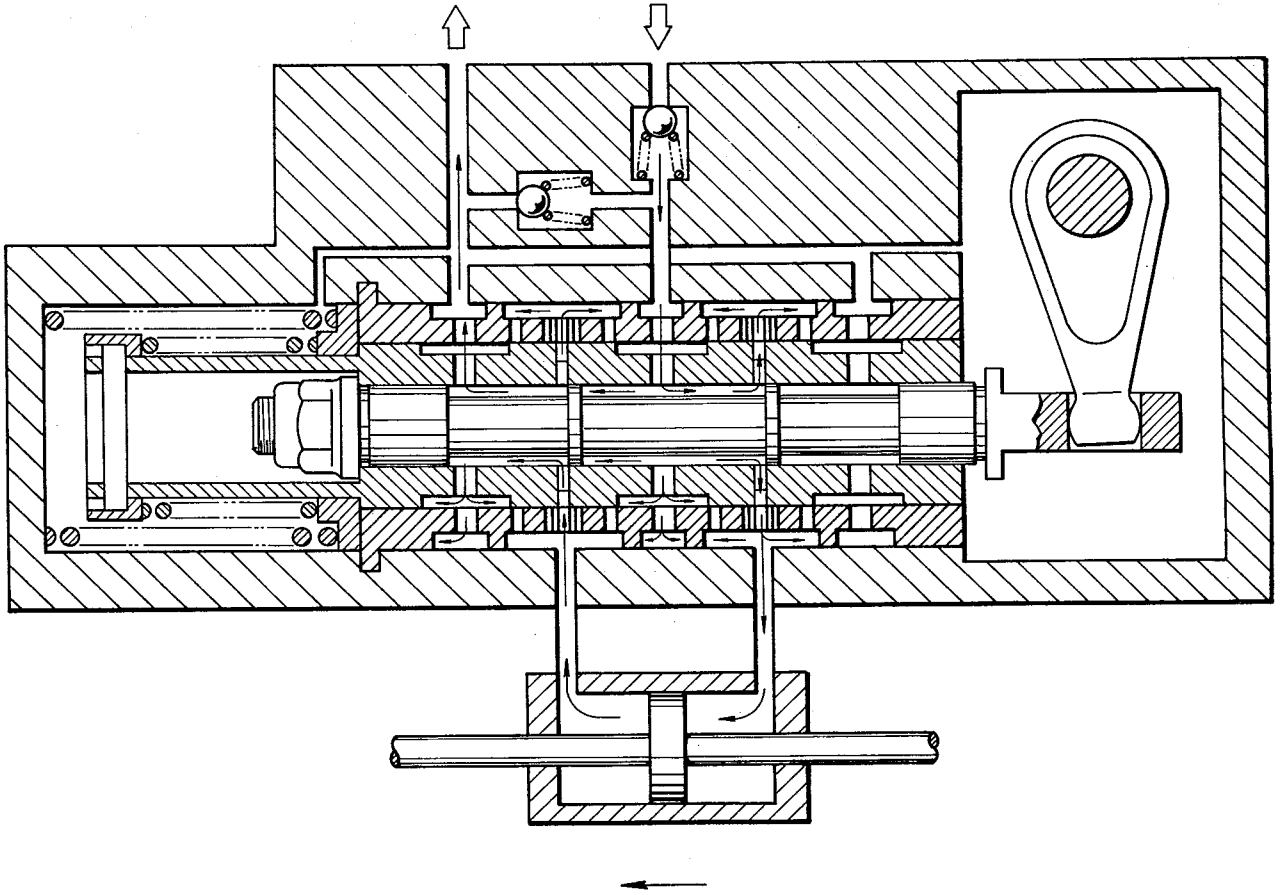

When the free end of the input lever 7 is rotated in a counterclockwise direction to engage the right surface of the nut 25 with the left surface of the cut-away portion 5*b* of the second sleeve 5 as shown in FIG. 5, the valve spool 6 is moved in a right direction so that the flanges 21 and 21′ assume respective positions rightward of the first and second orifices 27 and 27′. At this time, the pressure oil introduced through the inlet conduit 19 is fed to the right chamber 15*b* of the valve cylinder 15 through the check valve 39, the fourth annular groove 31, the fourth ports 30, the first annular groove 29, the first ports 28, the annular chamber 40, the first orifices 27, the first annular orifice groove 27*a*, the fifth orifices 34, the seventh annular groove 32 and the cylinder conduit 18, so that the piston 16 and the piston rods 17 and 17′ are caused to move rightwardly. On the other hand, the pressure oil remained in the left chamber 15*a* of the valve cylinder 15 is discharged from the outlet conduit 20 through the cylinder conduit 18′, the eighth annular groove 32′, the eighth orifices 36, the second annular orifice groove 27*a*′, the second orifices 27′, an annular chamber 42 defined by the flange 21′, the large diameter portion 23′, the small diameter portion 22″ and the inner wall of the second sleeve 5, and through the third ports 28″, the third annular groove 29″, the sixth ports 30″ and the sixth annular groove 31″. When the piston rods 17 and 17′ are leftwardly moved, the valve spool 6 is also leftwardly moved by the action of the feed-back mechanism so that the control valve returns the null position as shown in FIG. 3 to prevent the piston rods 17 and 17′ from excessively running.

Although the foregoing description is concerned with normal operations of the control valve, the stroke amount of the input lever 7 is preliminarily determined to have twice the width of each of the flanges 21 and 21′ for a quick operation required for a fail-safe function and urgency of aircrafts as will be described hereinafter in greater details. Under these events, the input lever 7 is able to be swung causing the valve spool 6 to move in a left direction without jamming or sticking of the spool 6 and the second sleeve 5 as particularly shown in FIG. 8 so that the pressure oil is introduced into the left chamber 15*a* of the valve cylinder 15 through the second orifices 27′ as well as through the sixth orifices 35, while being discharged out of the right chamber 15*b* of the valve cylinder 15 through the first orifices 27 as well as through the third orifices 33. On the other hand, when the valve spool 6 is adversely moved in a right direction by means of the input lever 7 without jamming or sticking of the spool 6 and the second sleeve 5 as particularly shown in FIG. 11, the pressure oil is introduced into the right chamber 15*b* of the valve cylinder 15 through the first orifices 27 and the fourth orifices 33′, while being discharged from the left chamber 15*a* of the valve cylinder 15 through the second orifices 27′ and the seventh orifices 35′. It is therefore to be understood that the input lever 7 is swing to move the spool 6 and the second sleeve 5 in either direction against the first coil spring 13 or the second coil spring 14 with a view to obtaining an actuator speed two times that of normal operation at its maximum.

There has been described normal operations in which the valve spool 6 and the second sleeve 5 are not jammed or stuck to each other, however, abnormal operations will be described hereinafter in such a condition that the normal operations are expected to be obtained due to the jamming between the valve spool 6 and the second sleeve 5.

Figure 6:
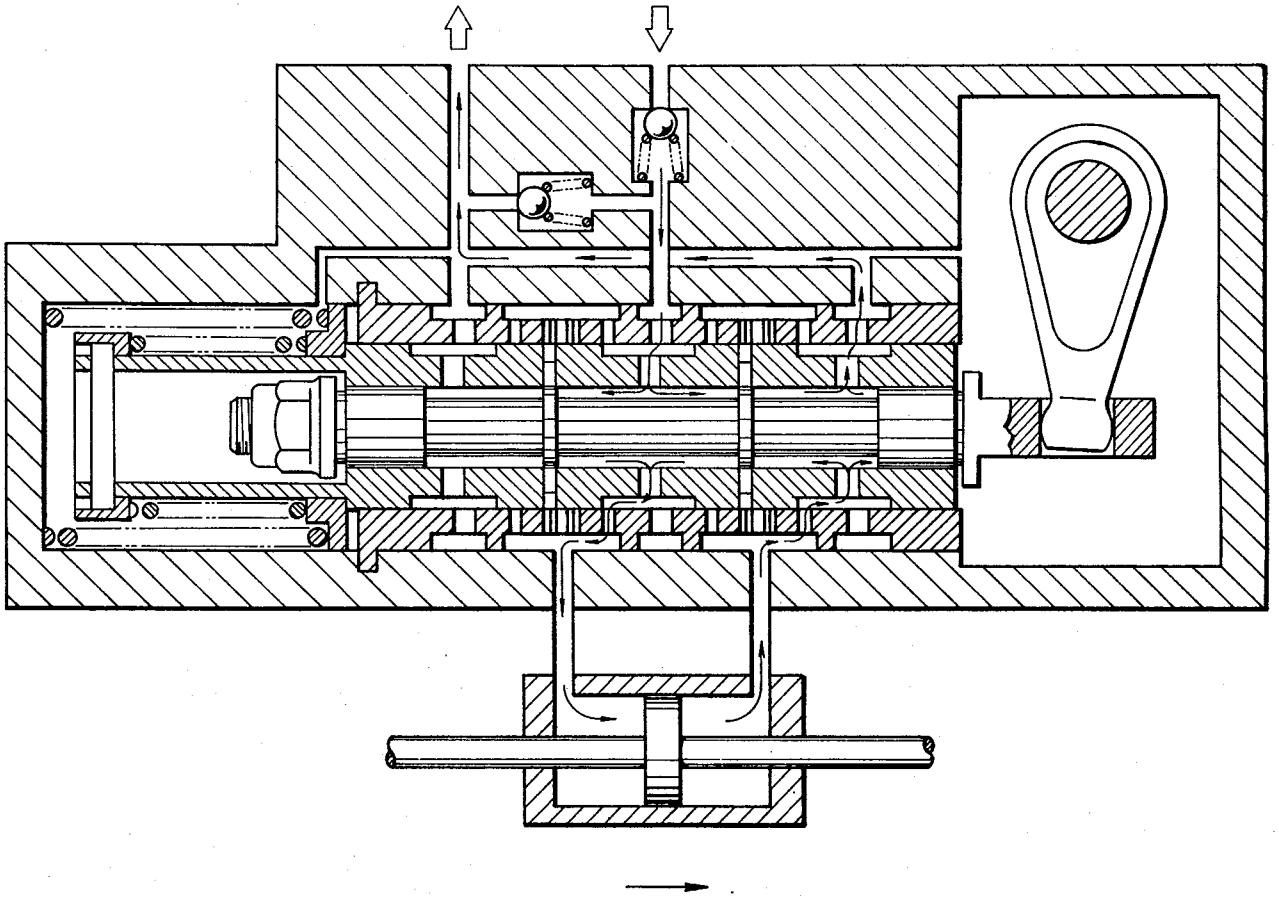
Figure 7:
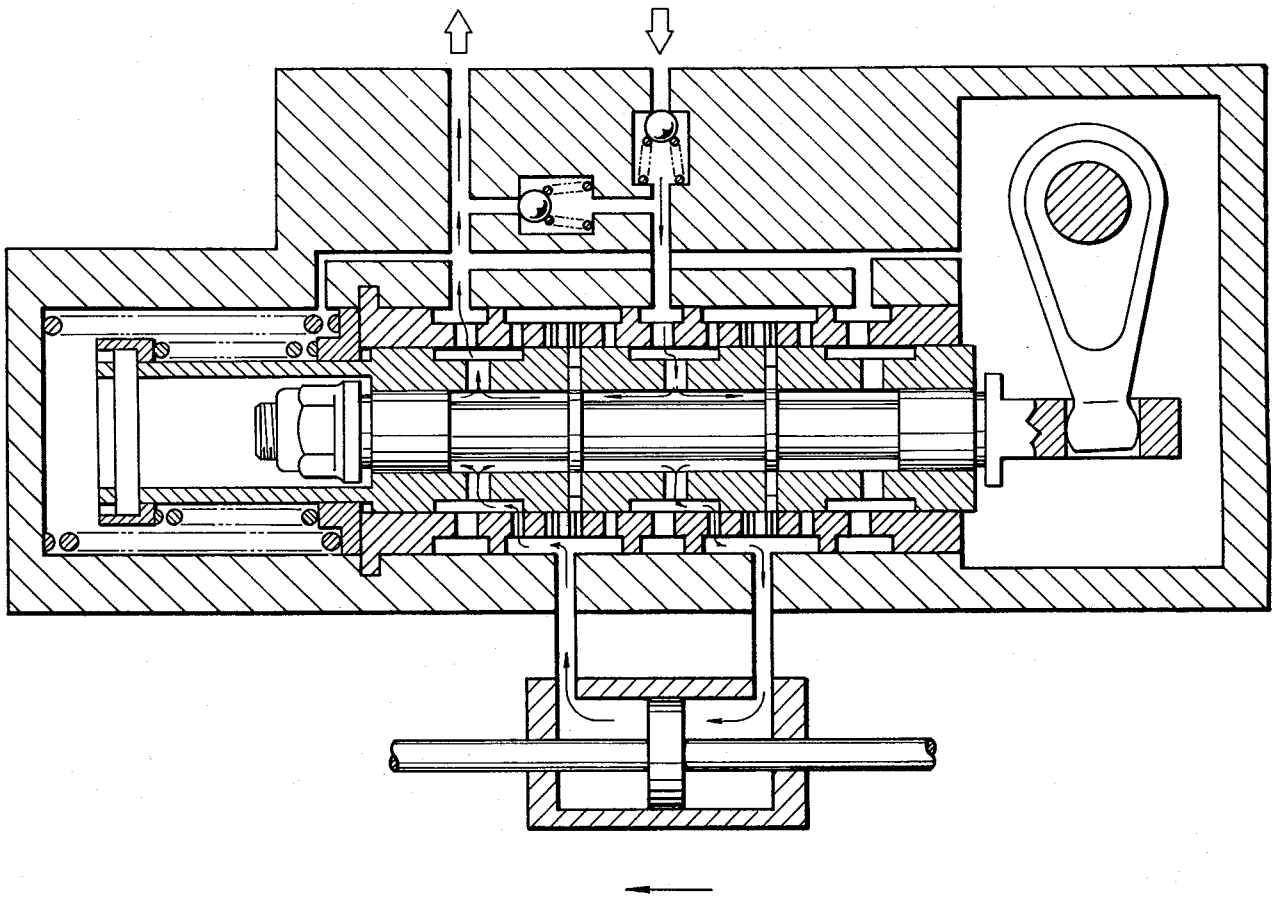

FIGS. 6 and 7 each illustrates a condition in which the control valve of the present invention can not normally be operated since the valve spool 6 is jammed or stuck to the second sleeve 5 while the first and second orifices 27 and 27′ are being closed by the flanges 21 and 21′, respectively as shown in FIG. 3. In order to rightwardly move the piston 16 and the piston rods 17 and 17′ under the condition, the free end of the input lever 7 is rotated in a clockwise direction to leftwardly move the valve spool 6 and the second sleeve 5 against the first coil spring 13 as shown in FIG. 6. At this time, the pressure oil in the inlet conduit 19 is supplied to the left chamber 15*a* of the valve cylinder 15 through the check valve 39, the fourth annular groove 31, the fourth ports 30, the first annular groove 29, the sixth orifices 35, the eighth annular groove 32′ and the cylinder conduit 18′. On the other hand, the pressure oil in the right chamber 15*b* of the valve cylinder 15 is discharged through the cylinder conduit 18, the seventh annular groove 32, the third orifices 33, the second annular groove 29′, the fifth ports 30′ and the fifth annular groove 31′. When the piston 16 and the piston rods 17 and 17′ are moved rightwardly, the valve spool 6 and the second sleeve 5 are rightwardly moved by means of the feed-back mechanism to assume their original or null positions shown in FIG. 3, resulting in prevention from the excessive runnings of the piston rods 17 and 17′. Additionally, to leftwardly move the piston 16 and the piston rods 17 and 17′ under the condition shown in FIG. 3, the free end of the input lever 7 is rotated in a counterclockwise direction to rightwardly move the valve spool 6 and the second sleeve 5 against the second coil spring 14 as shown in FIG. 7. At this time, the pressure oil in the inlet conduit 19 is supplied to the right chamber 15*b* of the valve cylinder 15 through the check valve 39, the fourth annular groove 31, the fourth ports 30, the first annular groove 29, the fourth orifices 33′, the seventh annular groove 32 and the cylinder conduit 18. On the other hand, the pressure oil in the left chamber 15*a* of the cylinder 15 is discharged through the cylinder conduit 18′, the eighth annular groove 32′, the seventh orifices 35′, the third annular groove 29″, the sixth ports 30″ and the sixth annular groove 31″. When the piston 16 and the piston rods 17 and 17′ are moved leftwardly, the valve spool 6 and the second sleeve 5 are leftwardly moved by means of the feed-back mechanism to assume their original or null positions shown in FIG. 3, thereby causing prevention from excessive runnings of the piston rods 17 and 17′.

Figure 8:
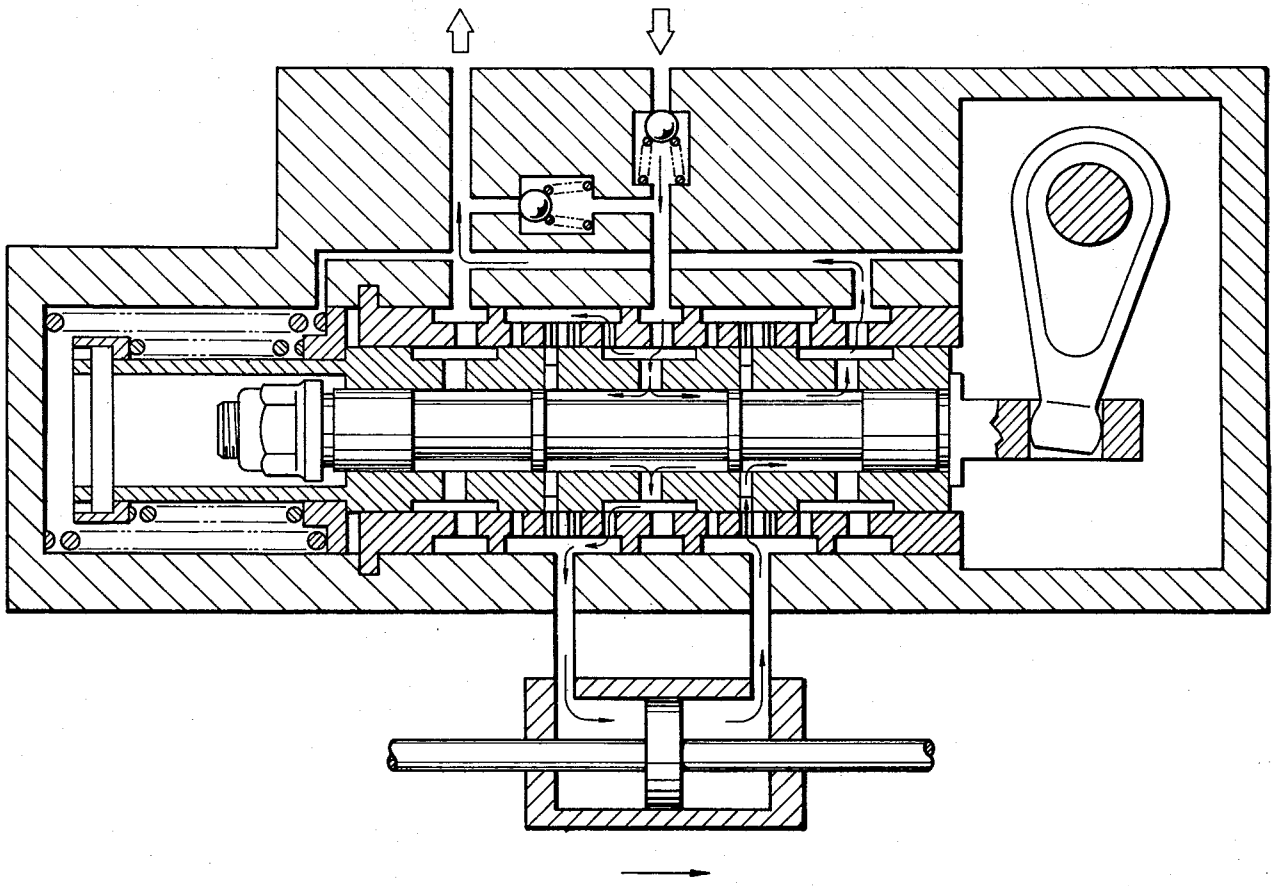
Figure 9:
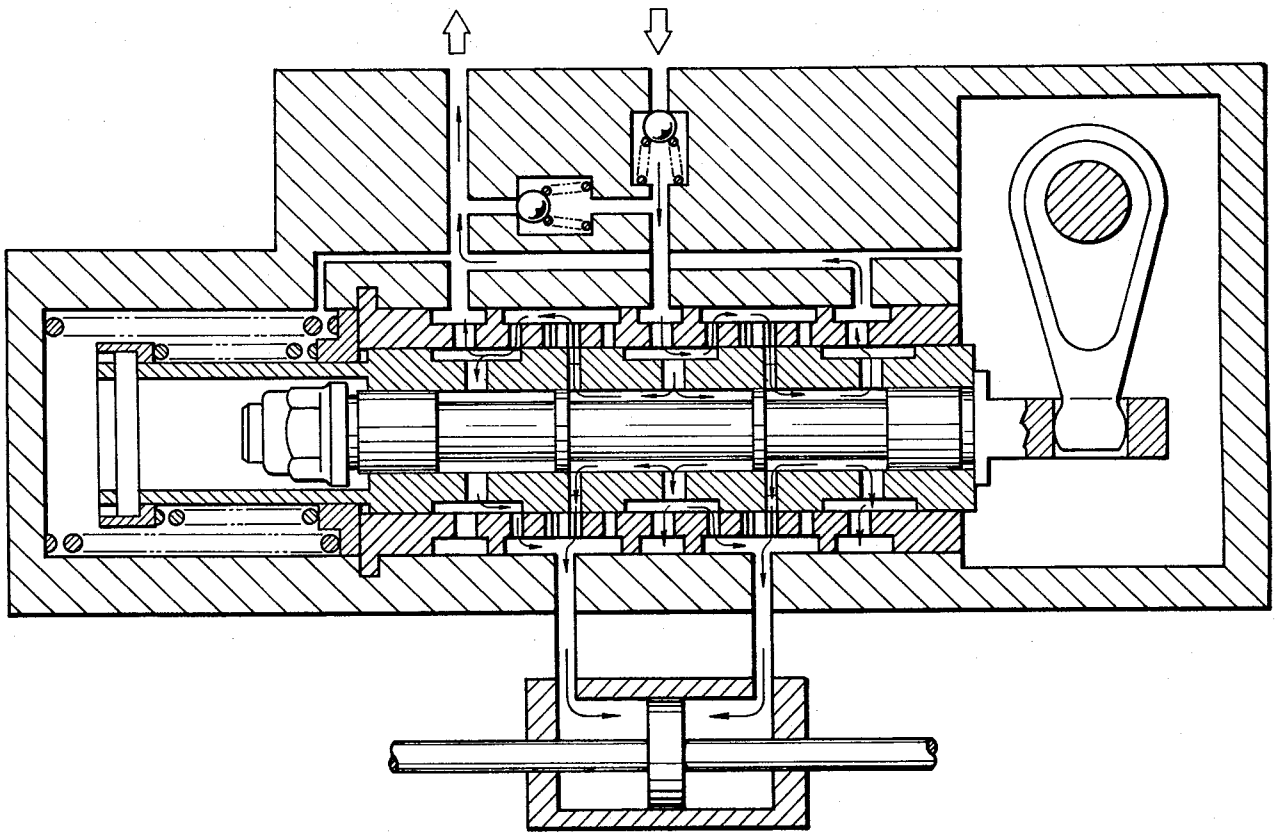
Figure 10:
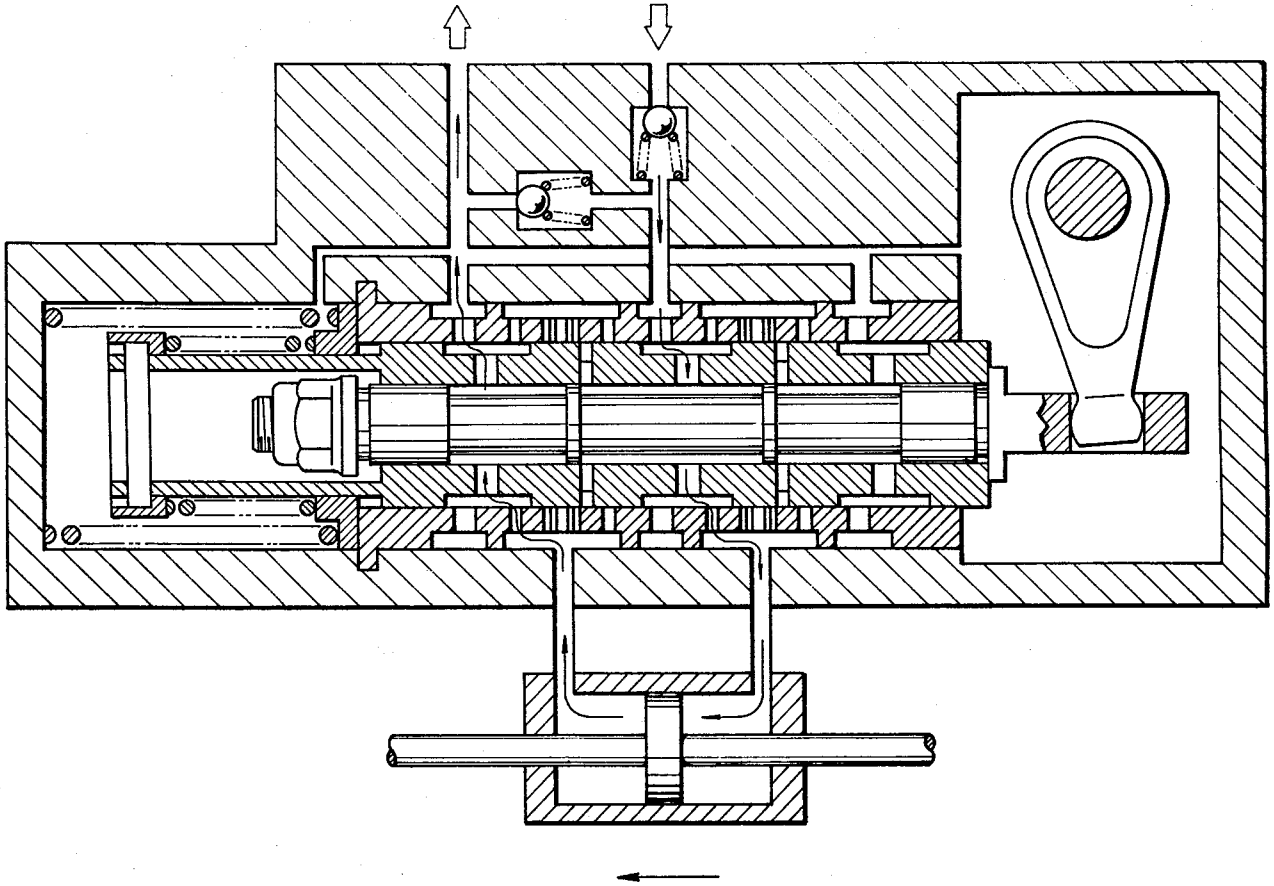

FIG. 8 and 10 each illustrates a condition in which the control valve of the present invention is operated while the valve spool 6 is held jammed to the second sleeve 5 upon movement of the flanges 21 and 21' leftwardly of the first and second orifices 27 and 27', respectively. In order to rightwardly move the piston 16 and the piston rods 17 and 17' from the conditions as shown in FIG. 9, the free end of the input lever 7 is rotated in a clockwise direction as shown in FIG. 8 to leftwardly move the spool 6 and the second sleeve 5 against the first coil spring 13. At this time, the pressure oil in the inlet conduit 19 is introduced into the left chamber 15*a* of the valve cylinder 15 through the check valve 39, the fourth annular groove 31, the fourth ports 30, the first annular groove 29, the sixth orifices 35, the eighth annular groove 32' and the cylinder conduit 18'. On the other hand, the pressure oil in the right chamber 15*b* of the valve cylinder 15 is discharged through the cylinder conduit 18, the seventh annular groove 32, the fifth orifices 34, the first annular orifice groove 27*a*, the first orifices 27, the annular chamber 41, the second ports 28', the second annular groove 29', the fifth ports 30', the fifth annular groove 31' and the outlet conduit 20. When the piston 16 and the piston rods 17 and 17' are rightwardly moved, the spool 6 and the second sleeve 5 are rightwardly moved to resume their original or null positions as shown in FIG. 9, thereby preventing the piston rods 17 and 17' from excessively running. At this time, the cylinder conduits 18 and 18' are short-circuited through the seventh annular groove 32, the fourth orifices 33', the first annular groove 29, the first ports 28, the annular chamber 40, the second orifices 27', the second annular orifice groove 27*a*', the eighth orifices 36 and the eighth annular groove 32'. Additionally, the leftwardly move the piston 16 and the piston rods 17 and 17' from the condtions as shown in FIG. 9, the free end of the input lever 7 is rotated in a counterclockwise direction as shown in FIG. 10 to rightwardly move the spool 6 and the second sleeve 5 against the second coil spring 14. At this time, the pressure oil in the inlet conduit 19 is supplied to the right chamber 15*b* of the valve cylinder 15 through the check valve 39, the fourth annular groove 31, the fourth ports 30, the first annular groove 29, the fourth orifices 33', the seventh annular groove 32 and the cylinder conduit 18. On the other hand, the pressure oil in the left chamber 15*a* of the valve cylinder 15 is discharged through the cylinder conduit 18', the eighth annular groove 32', the seventh orifices 35', the third annular groove 29'', the sixth ports 30'', the sixth annular groove 31'' and the outlet conduit 20. When the piston 16 and the piston rods 17 and 17' are leftwardly moved, the valve spool 6 and the second sleeve 5 are leftwardly moved by means of the feed-back mechanism to resume the original or null positions as shown in FIG. 9, preventing the piston rods 17 and 17' from excessively running.

Figure 11:
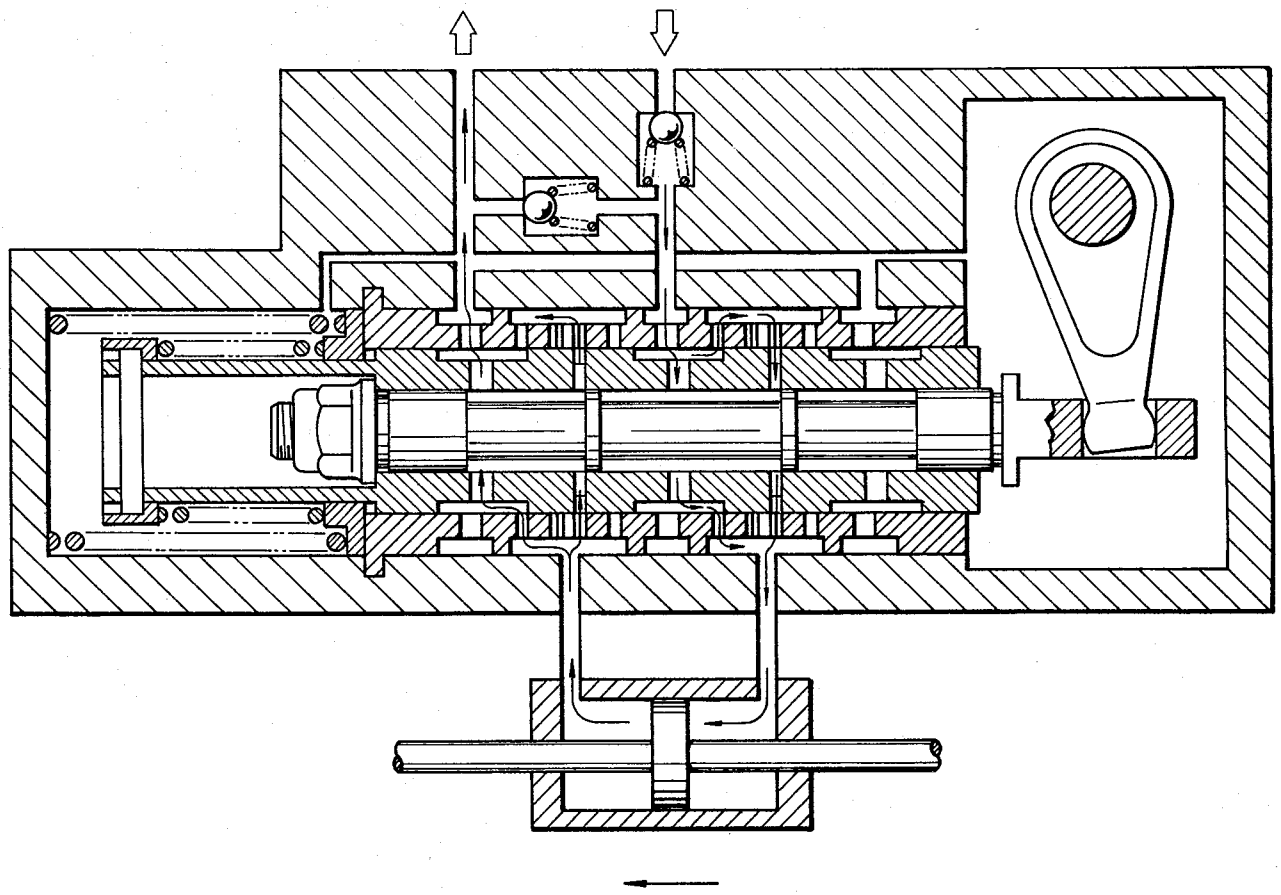
Figure 12:
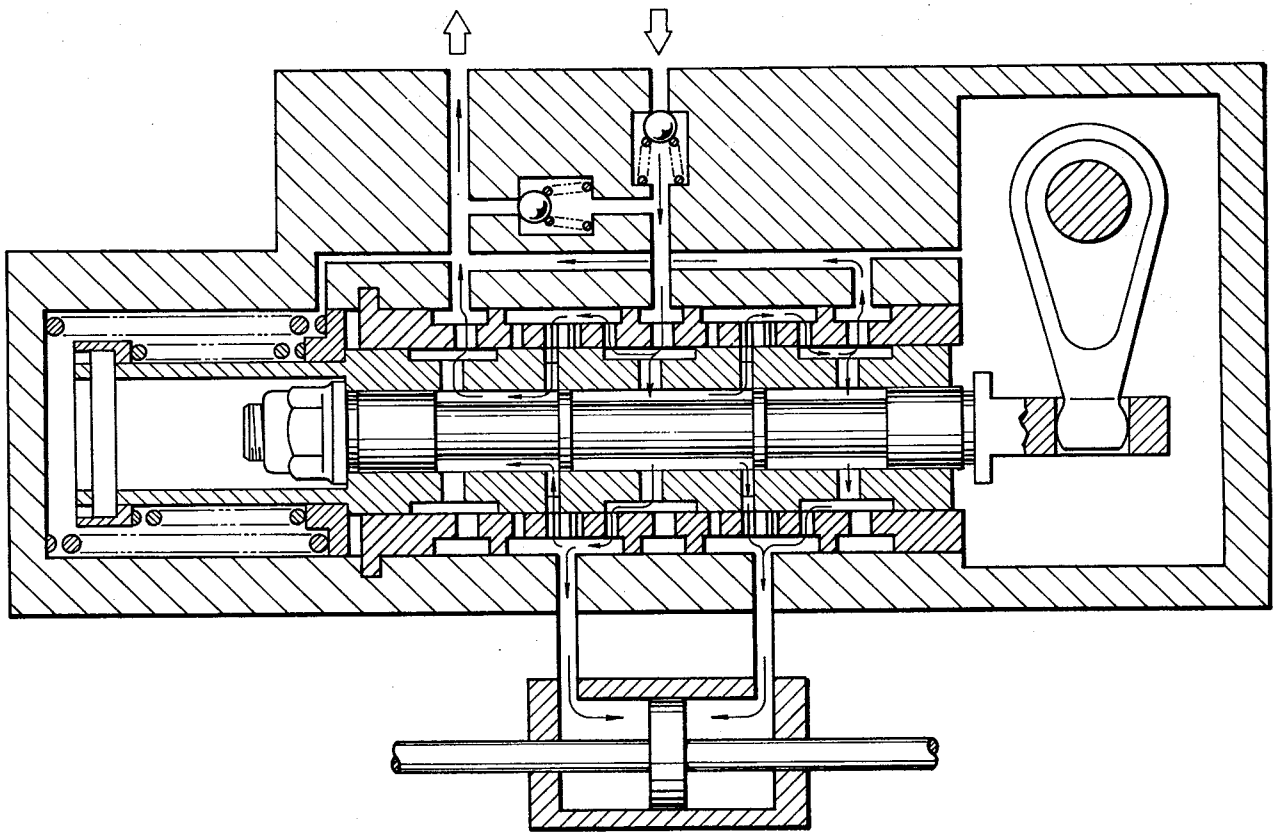
Figure 13:
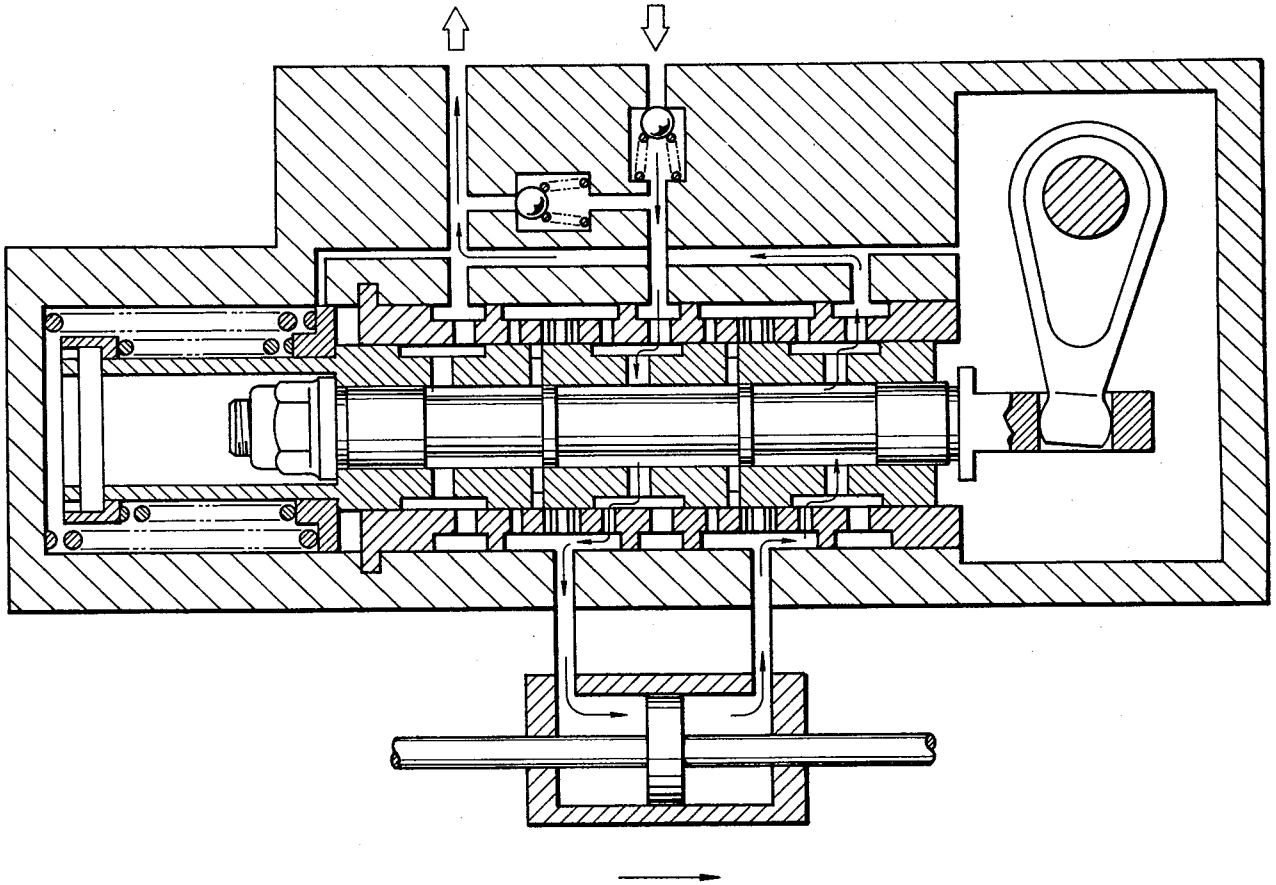

FIGS. 11 and 13 each illustrates a condition in which the control valve of the present invention is operated while the valve spool 6 is held jammed to the second sleeve 5 upon movement of the flanges 21 and 21' rightwardly of the first and second orifices 27 and 27', respectively. In order to leftwardly move the piston 16 and the piston rods 17 and 17' from the conditions as shown in FIG. 12, the free end of the input lever 7 is rotated in a counterclockwise direction as shown in FIG. 11 to rightwardly move the spool 6 and the second sleeve 5 against the second coil spring 14. At this time, the pressure oil in the inlet conduit 19 is supplied to the right chamber 15*b* of the valve cylinder 15 through the check valve 39, the fourth annular groove 31, the fourth ports 30, the first annular groove 29, the first ports 28, the annular groove 40, the first orifices 27, the first annular orifice groove 27*a*, the fifth orifices 34, the seventh annular groove 32 and the cylinder conduit 18. On the other hand, the pressure oil in the left chamber 15*a* of the valve cylinder 15 is discharged through the cylinder conduit 18', the eighth annular groove 32', the eighth orifices 36, the second annular orifice groove 27*a*', the second orifices 27', the annular chamber 42, the third ports 28'', the third annular groove 29'', the sixth ports 30'', the sixth annular groove 31''and the outlet conduit 20. When the piston 16 and the piston rods 17 and 17' are leftwardly moved, the spool 6 and the second sleeve 5 are leftwardly moved to resume their null positions as shown in FIG. 12, thereby preventing the piston rods 17 and 17' from excessively running. At this time, the cylinder conduits 18 and 18' are short-circuited through the seventh annual groove 32, the fifth orifices 34, the first annular orifice groove 27*a*, the first orifices 27, the annular chamber 40, the first ports 28, the first annular groove 29, the sixth orifices 35 and the eighth annular groove 32'. The first coil spring 13 is forced to be compressed by the cut-away portion 5*a* of the second sleeve 5 through the movable collar 12 when the control valve of the present invention resumes the null position as shown in FIG. 12 from the condition as shon in FIG. 11. Additionally, to rightwardly move the piston 16 and the piston rods 17 and 17' from the conditions as shown in FIG. 12, the free end of the input lever 7 is rotated in a clockwise direction as shown in FIG. 13 to leftwardly more the valve spool 6 and the second sleeve 5 against the first coil spring 13. At this time, the pressure oil in the inlet conduit 19 is furnished to the left chamber 15*a* of the valve cylinder 15 through the check valve 39, the fourth annular groove 31, the fourth ports 30, the first annular groove 29, the sixth orifices 35, the eighth annular groove 32' and the cylinder conduit 18'. On the other hand, the pressure oil in the right chamber 15*b* of the valve cylinder 15 is discharged through the cylinder conduit 18, the seventh annular groove 32, the third orifices 33, the second annular groove 29', the fifth ports 30', the fifth annular groove 31 and the outlet conduit 20. When the piston 16 and the piston rods 17 and 17' are rightwardly moved, the valve spool 6 and the second sleeve 5 are rightwardly moved by means of the feed-back mechanism to resume the null position as shown in FIG. 12, preventing the piston rods 17 and 17' from excessively running.

According to the present invention, the valve housing 1 may be fixed to any other suitable frame while the piston rods 17 and 17' are moved rightwardly or leftwardly, and the valve housing 1 may be moved in either direction while the piston rods 17 and 17' are securely connected to a suitable frame.

From the above-mentioned description, it will be noted that the control actuator can normally be operated even under such an abnormal condition that the valve spool is jammed at any positions to the second sleeve and that the null position can always be made constant under abnormal and normal conditions, which makes it possible for the control actuator to reliably coact with a control column operated by a pilot. The operating position of the pilot can be completely coincided with the operating position of the control actuator, thereby facilitating controllability by the pilot.

While certain representative embodiments and details have been shown for the purpose of explaining the present invention, it will be apparent to those skilled in the art that various changes and modifications may be made without departing from the spirit or scope of the present invention.

What is claimed is:

1. An improved combination of a valve cylinder and a fail-safe fluid control valve, employing a control valve, said control valve including: a valve housing (1) having first and second concave portions (2, 3) formed therein, a first sleeve (4) positioned within and fixed to said first concave portion of said housing, a reciprocably movable second sleeve (5) provided in said first sleeve, a reciprocably movable valve spool (6) provided in said second sleeve, an input lever (7) provided in said second concave portion of said valve housing being pivotally connected to an end portion of said valve spool for axially reciprocating said valve spool and said second sleeve upon jamming of said valve spool and said second sleeve, resilient means (13, 14) disposed within said first concave portion of said valve housing for moving said second sleeve at a predetermined position against the movement of said input lever, a valve cylinder (15), said valve cylinder being in fluid communication with said first concave portion of said valve housing, an inlet conduit (19) arranged in said valve housing for supplying pressurized oil to said first concave portion of said valve housing, an outlet conduit (20) disposed in said valve housing for discharging said oil from said first concave portion of said valve housing, a pair of cylinder conduits (18, 18') connecting said first concave portion of said valve housing and said valve cylinder, for supplying said pressurized oil to said valve cylinder and discharging said oil from said valve cylinder, the improvement comprising:

a pair of annular flange members (21, 21') formed on said valve spool forming first, second and third small diameter portions (22, 22', 22'') at predetermined distances therebetween in an axial direction;

said second sleeve including first and second orifice means (27, 27') each having radial bore means in circumferential alignment, said first and second orifice means being at a predetermined distance in the axial direction substantially equal to that of each of said annular flanges, being in opposition thereto for closing by said annular flanges; first, second and third port means (28, 28', 28'') opposed to said first, second and third small diameter portions, respectively, and each of said port means being defined by at least one radial bore formed in circumferential alignment with each other in said second sleeve; and first, second and third annular grooves (29, 29', 29'') formed in an outer wall portion of said second sleeve being in fluid communication with said first, second and third of port means, respectively;

said first sleeve including fourth, fifth and sixth port means (30, 30', 30'') opposing said first, second and third annular grooves, respectively, of said second sleeve and each port means defined by at least one radial bore means in circumferential alignment in said first sleeve, fourth, fifth and sixth annular grooves (31, 31', 31'') in the outer wall portion of said first sleeve being in fluid communication with said fourth, fifth and sixth port means, said fourth annular groove being in fluid communication with said inlet conduit, and said fifth and sixth annular grooves being in fluid communication with bifurcated ends of said outlet conduit; a seventh annular groove (32) formed in the outer wall portion of said first sleeve between said fourth and fifth annular grooves and in fluid communication with one of said cylinder conduits; an eighth annular groove (32') formed in the outer wall portion of said first sleeve between said fourth and sixth annular grooves and in fluid communication with the other of said cylinder conduits; fifth orifice means (34) formed in said first sleeve having radial bore means in circumferential alignment and each of said bore means being of a length substantially three times that of each of said flanges in the axial direction, each bore means having an outer opening in fluid communication with said seventh annular groove and an inner opening in fluid communication with the inner wall of said first sleeve; third and fourth orifice means (33, 33') formed in said first sleeve positioned in axial spaced relation with sides of said fifth orifice means, each of said fifth orifice means having radial bore means in circumferential alignment and each bore means having a length substantially equal to that of each of said flanges in the axial direction, said third and fourth orifice means of said bores having respective outer opening in fluid communication wtih said seventh annular groove and respective inner openings closed by an outer wall of said second sleeve upon said fifth orifice means coinciding with said first orifice means in the axial direction; an eighth orifice means (36) formed in said first sleeve and having radial bore means in circumferential alignment, each bore means having a length substantially equal to three times that of each of said flanges, each bore means having an outer opening in fluid communication with said eighth annular groove and an inner opening in fluid communication with said second orifice means upon said fifth orifice means axially coinciding with said first orifice means; sixth and seventh orifice means (35, 35') formed in said first sleeve being positionable in axially spaced relation with sides of said eighth orifice means and each sixth and seventh orifice means having radial bore means in circumferential alignment and each bore means having a length substantially equal to that of each of said flanges in the axial direction, said sixth and seventh orifice means of said bore means having respective outer openings in fluid communication with said eighth annular groove and respective inner openings closed by the outer wall of said second sleeve upon said fifth orifice means being axially coincidental with said first orifice means.

2. A fail-safe fluid control valve as claimed in claim 1, wherein: each bore of said fifth orifice means (34) having a large central cross-sectioned aperture (34*a*), a pair of small cross-sectioned side apertures (34*b*) positioned at both sides of said large central cross-sectioned aperture, and a pair of tapered intermediate cross-sectioned apertures (34*c*) positioned between and connecting said central and side apertures, respectively, and each bore of said eighth orifice means (36) having a large central cross-sectioned aperture (34*a*), a pair of small cross-sectioned side apertures (34*b*) positioned at both sides of said large central cross-sectioned aperture, and a pair of tapered intermediate cross-sectioned apertures (34*c*) positioned between and connecting said central and side apertures.

3. A fail-safe fluid control valve as claimed in claim 1, including: a first annular orifice groove (27*a*) formed in the outer wall portion of said second sleeve being in axial alignment with said first orifice means, and a second annular orifice groove (27*a*') formed in the outer wall portion of said second sleeve in axial alignment with said second orifice means.

* * * * *